US008870318B2

(12) United States Patent
Rice et al.

(10) Patent No.: US 8,870,318 B2
(45) Date of Patent: Oct. 28, 2014

(54) SYSTEM AND METHOD USING INK USAGE ADJUSTMENT VALUES

(75) Inventors: Huston W. Rice, Vancouver, WA (US); David B. Novak, Philomath, OR (US); Brian Woods, Leixlip (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 38 days.

(21) Appl. No.: 13/697,121

(22) PCT Filed: May 11, 2010

(86) PCT No.: PCT/US2010/034359

§ 371 (c)(1), (2), (4) Date: Nov. 9, 2012

(87) PCT Pub. No.: WO2011/142747

PCT Pub. Date: Nov. 17, 2011

(65) Prior Publication Data

US 2013/0057606 A1 Mar. 7, 2013

(51) Int. Cl.
*B41J 2/195* (2006.01)
*B41J 2/175* (2006.01)

(52) U.S. Cl.
CPC ..... *B41J 2/17553* (2013.01); *B41J 2/17546* (2013.01)
USPC ..... 347/7

(58) Field of Classification Search
CPC ..... B41J 2002/17569; B41J 2002/17576; B41J 2002/17589
USPC ..... 347/7, 84–86
See application file for complete search history.

(56) References Cited

U.S. PATENT DOCUMENTS

| | | | |
|---|---|---|---|
| 5,699,091 | A | 12/1997 | Bullock et al. |
| 5,812,156 | A | 9/1998 | Bullock et al. |
| 6,217,149 | B1 | 4/2001 | Takagi et al. |
| 6,344,903 | B1 | 2/2002 | Derhak et al. |
| 6,371,586 | B1 | 4/2002 | Saruta |
| 2002/0126301 | A1 | 9/2002 | Bowers |
| 2009/0128596 | A1 | 5/2009 | Babu et al. |
| 2009/0153602 | A1 | 6/2009 | Brown et al. |
| 2009/0167794 | A1 | 7/2009 | Hosono et al. |

FOREIGN PATENT DOCUMENTS

JP 2001187457 7/2001

OTHER PUBLICATIONS

Supplementary European Search Report for Application No. EP10851502.4. Report issued Oct. 21, 2013.

*Primary Examiner* — An Do

(57) ABSTRACT

A method for tuning ink usage includes storing an ink usage adjustment value in a memory of an ink cartridge; and with a printing system utilizing the ink cartridge, adjusting an ink usage of the ink cartridge based on the ink usage adjustment value. An ink cartridge includes a memory for storing an ink usage adjustment value, the ink usage adjustment value based on ink usage properties of the cartridge. A printing system utilizing the ink cartridge adjusts an ink usage of the ink cartridge based on the ink usage adjustment value.

13 Claims, 6 Drawing Sheets

Adjustment Value Table
(300)

302 304

| SKU | Adjustment Value |
|---|---|
| 11 | 104% |
| 12 | 103% |
| 13 | 97% |
| 14 | 94% |
| 15 | 101% |

*Fig. 3*

Ink Usage Adjustment Value Table (500)

| Ink Usage Adjust Bits (502) | Ink Usage Adjustment Value (504) |
|---|---|
| 0 0 0 0 | Not Yet Programmed |
| 0 0 0 1 | 50% |
| 0 0 1 0 | 92% |
| 0 0 1 1 | 93% |
| 0 1 0 0 | 94% |
| 0 1 0 1 | 95% |
| 0 1 1 0 | 96% |
| 0 1 1 1 | 97% |
| 1 0 0 0 | 98% |
| 1 0 0 1 | 99% |
| 1 0 1 0 | 101% |
| 1 0 1 1 | 102% |
| 1 1 0 0 | 103% |
| 1 1 0 1 | 104% |
| 1 1 1 0 | 105% |
| 1 1 1 1 | No Change |

Alternate Print Mode (506)

Standard Ink Usage Adjustment (508)

Nominal Ink Usage (510)

*Fig. 5*

SYSTEM AND METHOD USING INK USAGE ADJUSTMENT VALUES

RELATED APPLICATIONS

The present application claims the priority under 35 U.S.C. 119(a)-(d) or (f) and under C.F.R. 1.55(a) of previous International Patent Application No. PCT/US2010/034359, filed May 11, 2010, entitled "System and Method Using Ink Usage Adjustment Values," which is incorporated herein by reference in its entirety.

BACKGROUND

Inkjet printing systems are commonly used for both large scale printing on banners and other signage items as well as small scale general consumer printing. Inkjet printing systems typically include a number of nozzles configured to eject ink onto a print medium such as paper. The nozzles are part of a print head which is often integrated with an ink cartridge. The ink cartridge includes a main ink reservoir where ink is stored before it is fed to the nozzles for ejection onto the print medium. Ink cartridges are typically placed onto a movable cartridge platform which moves the ink cartridges and thus the print head nozzles in relation to the print medium as the ink is being ejected at the appropriate time to form the intended image.

Ink cartridges are typically designed to be inserted into a particular printing system. Ink cartridges are generally designed to be replaceable. When an ink cartridge runs out of ink, a user may simply replace the old ink cartridge with a new ink cartridge. As ink cartridges are manufactured, small differences in the fabrication process may affect their ink usage.

BRIEF DESCRIPTION OF THE DRAWINGS

The accompanying drawings illustrate various embodiments of the principles described herein and are a part of the specification. The illustrated embodiments are merely examples and do not limit the scope of the claims.

FIG. 3 is a diagram showing an illustrative adjustment value table, according to one embodiment of principles described herein.

FIG. 5 is a diagram showing an illustrative ink usage adjustment value table, according to one embodiment of principles described herein.

Throughout the drawings, identical reference numbers designate similar, but not necessarily identical, elements.

DETAILED DESCRIPTION

Figure 1:
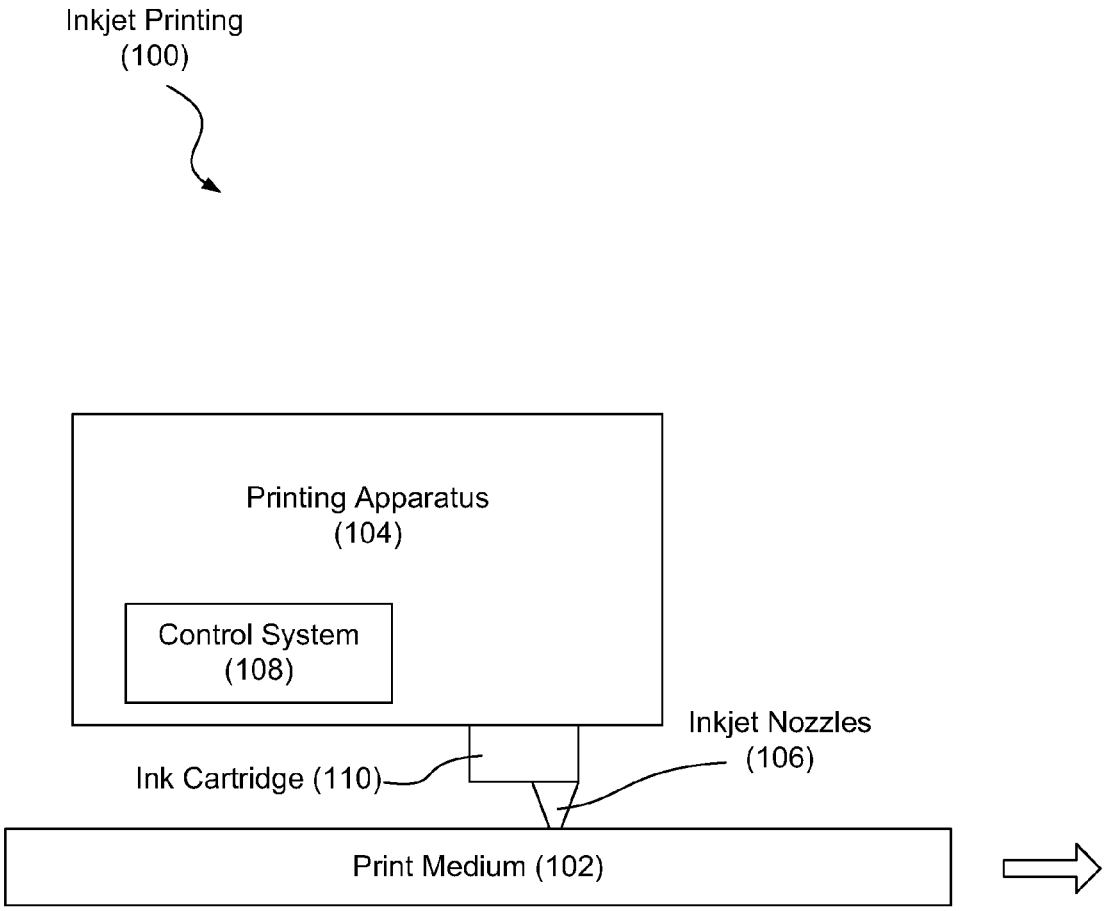
FIG. 1 is diagram showing illustrative inkjet printing principles, according to one embodiment of principles described herein.

Variations in physical components, such as foam within an ink cartridge or back pressure, can impact the amount of ink available for use or the rate of ink usage. Additionally, different inks may be of slightly different physical and chemical properties. For example, some types of inks are more viscous than others. The viscosity of a type of ink can affect the usage of that ink when placed into an ink cartridge. It would be beneficial to have an ink cartridge with tunable ink usage properties. Such an ink cartridge may be manufactured as a standard cartridge and can be filled with different types of ink. The ink usage properties may then be tuned based on the physical and chemical properties of the ink. Consequently, a method for tuning the ink usage of an ink cartridge is disclosed.

According to certain illustrative examples, a memory component of an ink cartridge may be used to store bits representing an ink usage adjustment value. The ink usage adjustment value may be based on measured ink usage properties of the ink cartridge. These measured ink usage properties may be specific to each ink cartridge and determined through various tests performed on that ink cartridge during or soon after the manufacturing process. An ink cartridge and a printing system capable of tuning ink usage also are disclosed.

Once stored in the memory component of the ink cartridge, the ink usage adjustment value may be communicated to a printing system utilizing the ink cartridge. The printing system may then adjust the ink usage of that particular ink cartridge, e.g., to meet an overall target ink usage. The ink usage adjustment value may be set by the manufacturer of the ink cartridge. Through use of methods and systems embodying principles described herein, an ink cartridge is provided that reaches a target ink usage. The ink usage adjustment amount can be at a value that is used to reach a product specification or target ink usage but that does not result in a noticeable difference in the printed image.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Throughout this specification and in the appended claims, the term "ink" is to be broadly interpreted as any fluid capable of being ejected onto a print medium. Ink may be dyed specific colors to print an intended image onto the print medium.

Throughout this specification and in the appended claims, the term "ink cartridge" is to be broadly interpreted as a set of inkjet nozzles of a particular color. An ink cartridge may include one or more printheads.

Referring now to the figures, FIG. 1 is a diagram showing an illustrative inkjet printer (100). According to certain illustrative embodiments, a print engine (104) of the printer (100) includes a control system (108) and an ink cartridge (110) with a printhead having a number of inkjet nozzles (106). The printer (100) typically includes a print medium feeding mechanism that moves a print medium (102) past the nozzles (106) of the cartridge (110) as ink is ejected. Additionally or alternatively, the printer (100) may include an ink cartridge carriage that moves the ink cartridge (110) and nozzles (106) with respect to the print medium (102) as the ink is ejected.

The control system (108) may include components of a standard physical computing system such as a processor and a memory. The memory may include a set of instructions that cause the processor to perform certain tasks related to the printing of images. For example, the control system (108) may manage the various mechanical components within the print engine (104). Additionally, the control system (108) may convert the image data sent from a client computing system to a format which is used by the print engine (104).

The ink cartridge (110) may be designed to support several printheads. Each printhead may dispense a different color of ink such that full-color images can be produced. As the ink cartridge (110) moves with respect to the print medium (102) and/or the print medium (102) moves underneath the ink cartridge (110), the control system (108) may send a signal to the appropriate inkjet nozzle (106) attached to the printheads of the ink cartridge (110) to eject an ink droplet. Ink droplets are ejected in a specific pattern so as to create an intended image on print medium (102).

The inkjet nozzles (106) may be configured to eject ink onto the print medium (102) through a variety of methods. One method, referred to as thermal inkjet printing, includes a small ink chamber containing a droplet of ink. A heating resistor is used to heat the ink chamber to a specific temperature when an electric current is applied. Due to various physical properties, this heating increases the pressure inside the small ink chamber and propels the droplet out of the nozzle (106) and onto the print medium (102). The void in the chamber then draws in more ink from a main ink chamber. The control system (108) may be used to cause electric current to flow through the appropriate heating resistors at the appropriate times.

Figure 2A:
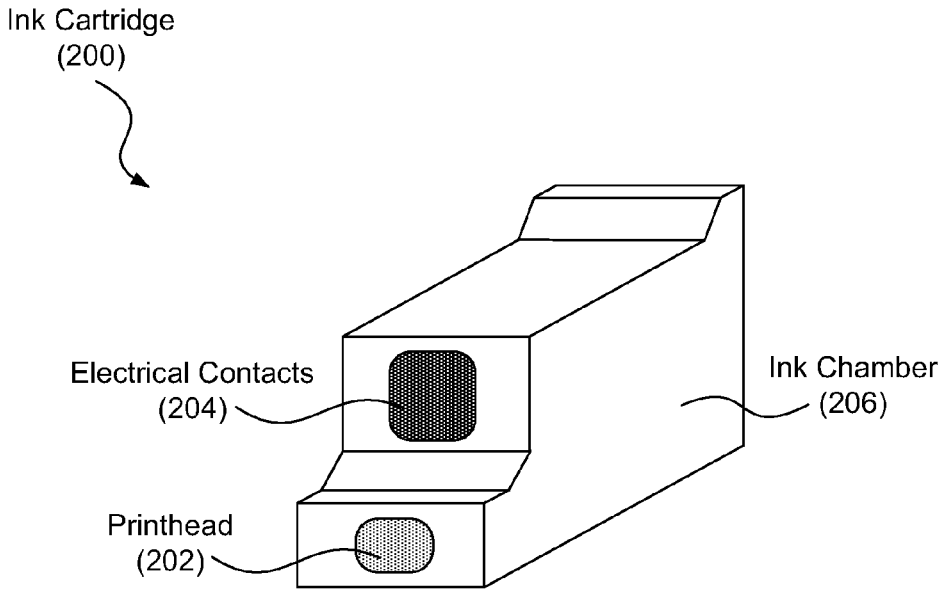
FIG. 2A is a diagram showing a perspective view of an illustrative ink cartridge, according to one embodiment of principles described herein.

FIG. 2A is a diagram showing a perspective view of an illustrative ink cartridge (200). According to certain illustrative embodiments, the ink cartridge (200) includes at least one printhead (202), a group of electrical contacts (204) and an ink chamber (206). Printhead(s) (202) may be designed in a variety of shapes and sizes to fit the specific printing systems for which they are designed. In some cases, an ink cartridge (200) may contain an ink chamber (206) for only one color. In other cases, an ink cartridge (200) may include a number of ink chambers (206) each storing a different ink color.

The printhead (202) includes the actual physical nozzles from which ink is ejected onto the print medium. Each physical nozzle is connected to a fire line. The fire line is an electrical line for carrying an electrical signal of sufficient power to heat a resistor associated with that physical nozzle. The resistor is heated sufficiently to propel a small droplet of ink from a small firing ink chamber associated with the nozzle. Upon ejecting the ink from the firing chamber, the void in the chamber draws more ink from the main ink chamber (206).

The various electrical lines, such as fire lines, may interface with the printing system through a group of electrical contacts (204) on the exterior of the ink cartridge (200). The electrical contacts (204) may be made of an electrically conductive material such as a metallic material. The electrical contacts may be designed to make contact with another set of geometrically similar electrical contacts on a cartridge platform associated with the printing system. Thus, an electrical signal may travel from the printing system, to an electrical interface on the cartridge platform, through the electrical contacts (204), and ultimately to the printhead (202).

The electrical contacts (204) are also used to carry an electrical signal from a memory (207) of the printhead (202). The memory (207) of the printhead (202) may be configured to store information about the properties of the printhead (202). For example, the memory (207) may store information such as the ink color and type employed by the printhead. As described above and in more detail below, the memory (207) may also include an ink usage adjustment value. This information may be communicated to a printing system utilizing the ink cartridge.

Figure 2B:
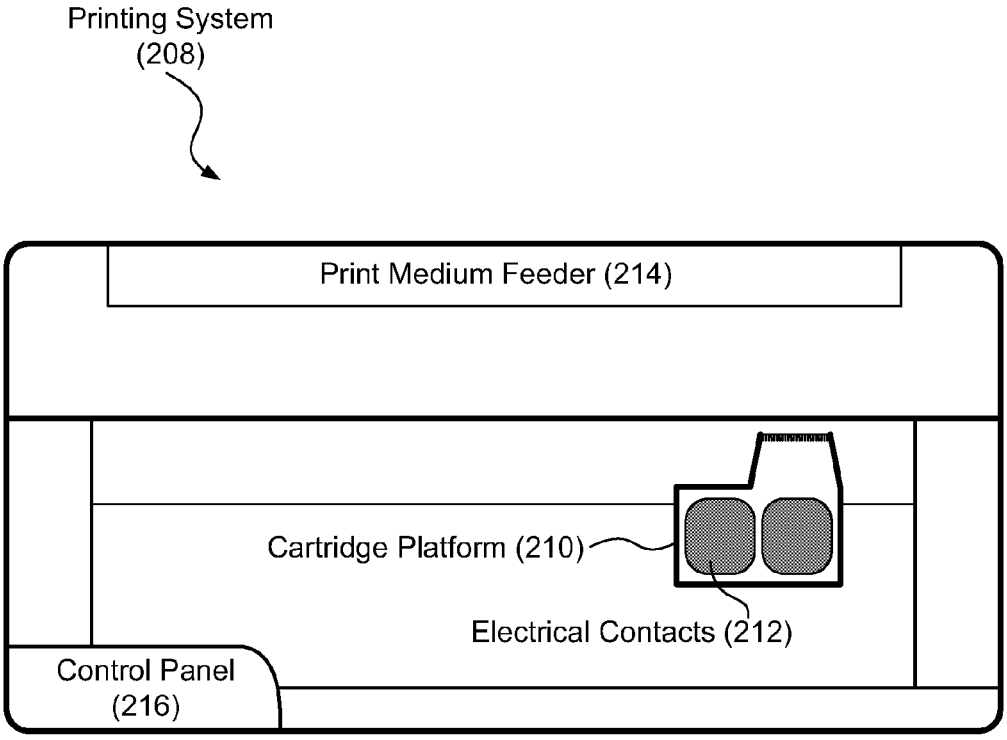
FIG. 2B is diagram showing a top view of an illustrative inkjet printing system, according to one embodiment of principles described herein.

FIG. 2B is diagram showing a top view of an illustrative inkjet printing system (208). According to certain illustrative embodiments, the printing system includes a cartridge platform (210) having electrical contacts (212) disposed thereon. The printing system (208) may also include a print medium feeder (214) and a control panel (216). A typical printing system (208) may have a chassis with a hood to cover the cartridge platform (210) from view. The hood may be lifted to replace ink cartridges or perform other maintenance tasks on the printing system (208).

The cartridge platform (210) will securely hold the ink cartridges (200) used by the printing system. In some embodiments, the printing system (208) may use an ink cartridge (200) which holds printheads for both black ink and colored inks. In some cases, the printing system (208) may be designed to use separate ink cartridges for black ink and colored inks.

The cartridge platform (210) securely holds the ink cartridges (200) in a manner such that the printhead (202) of the ink cartridge (200) may be placed within close proximity to a print medium. In this configuration, the cartridge platform (210) is movable along the position under which the print medium will pass. Thus, as the cartridge platform (210) moves along, the printheads (200) may receive signals indicating when to fire specific nozzles to form the intended image.

The signals indicating which nozzles are to fire at what time may be received through an electrical interface of the cartridge platform (210). That electrical interface includes the electrical contacts (212) which, as mentioned above, are positioned in a manner similar to the electrical contacts (204) of the ink cartridge (200).

The print medium feeder (214) may be a structure configured to receive a supply or stack of sheets of a print medium to be used for printing. The printer (208) may pull individual sheets of print medium through the printer (208) at the desired speed in order to allow the ink to be printed in the proper locations to form a desired image.

A control panel (216) includes a user interface to allow a user to control or configure the printer and make use of various features and options which are available with the printer (208). The control panel (216) may include such user interface devices, for example, as buttons and a display device.

FIG. 3 is a diagram showing an illustrative ink usage adjustment value table (300). The ink usage adjustment value table (300) illustrates how an adjustment value may be assigned to cartridges of various Stock Keeping Units (SKUs). The table includes a SKU column (302), and an adjustment value column (304).

A particular ink cartridge for a specific printing system may be designed to hold ink cartridges of slightly different designs. Each ink cartridge may be identified by a SKU number. Ink cartridges of different SKU numbers may behave slightly differently than each other due to small differences in the design and/or manufacturing process. Additionally, ink cartridges of the same SKU number may behave differently due to various variances and inconsistencies within the manufacturing process. The SKU numbers shown in FIG. 3 in the SKU column (302) are for illustrative purposes and do not represent an actual SKU for a particular ink cartridge.

In some cases, ink cartridges are filled with different types of inks having slightly different physical and chemical properties. Different types of ink may behave differently when ejected from the same type of ink nozzle. For example, some inks are more or less viscous than others. The viscosity of an ink can affect its usage properties. For example, an ink cartridge using a more viscous ink type may draw a smaller volume of ink to be fired by its ink nozzles. Conversely, an ink cartridge with a less viscous type of ink may draw a greater volume of ink to be fired by its ink nozzles.

An ink cartridge of a particular SKU may be tested to determine its ink usage properties. A projected ink usage may be calculated based on a number of tests performed on the ink cartridge during and/or soon after the manufacturing process. For example, the ink cartridge to be tested may be put to use under carefully controlled conditions. Various metrics may be taken during the testing process. For example, the average drop weight of the ink droplets being ejected onto a print medium may be determined. This may help determine an approximate ink usage characteristic for the ink cartridge.

As mentioned above, it is beneficial to provide a product with tunable operating characteristics. This includes an ink cartridge that uses ink in a manner that meets product specifications for quality and that can meet a target rate of ink usage.

Accordingly, the adjustment value column (304) shows the amount by which the ink usage should be adjusted to bring the actual ink usage of an ink cartridge to its target ink usage. For example, SKU number 11 has an ink usage adjustment value of 104%. That is, the printing system utilizing this ink cartridge may adjust the ink usage by 104% of a nominal ink usage. In a further example, an ink cartridge having SKU number 13 has an ink usage adjustment value of 97% of the nominal ink usage. The nominal ink usage may be the average ink usage of a particular ink cartridge design. In an example, by adjusting the ink usage properties of ink cartridges, a standardized ink usage may be realized.

In various examples of the principles described herein, the ink usage adjustment value may be assigned to a particular product line, as indentified in FIG. 3 by SKU. In other examples, the ink usage adjustment value may be assigned to each individual ink cartridge based on testing of the cartridge. In either case, the appropriate ink usage adjustment value is then stored in the memory unit of the cartridge, as mentioned above, to be read and utilized by the printer in which that cartridge is deployed.

The printer utilizing a particular ink cartridge may then adjust the ink usage by, for example, causing the ink nozzles of the cartridge to fire more times or fewer times than usual. For example, the printing system may make adjustments to a half-toning function used to print images. Half-toning is a commonly used method of printing dots in a manner that causes the human eye to see an intended image. Ink jet printing systems typically print a large number of very small dots. Viewed from afar, these small dots printed closely together may appear as a solid image. By making adjustments to the half-toning function used by the printing system to print a desired image, more or fewer dots may be used to print the desired image. Printing fewer dots may reduce the ink usage of the ink cartridge. Printing more dots may increase the ink usage of the ink cartridge. In either case, the adjustment may serve to standardize the operation of different cartridges to attain a target ink usage.

Figure 4:
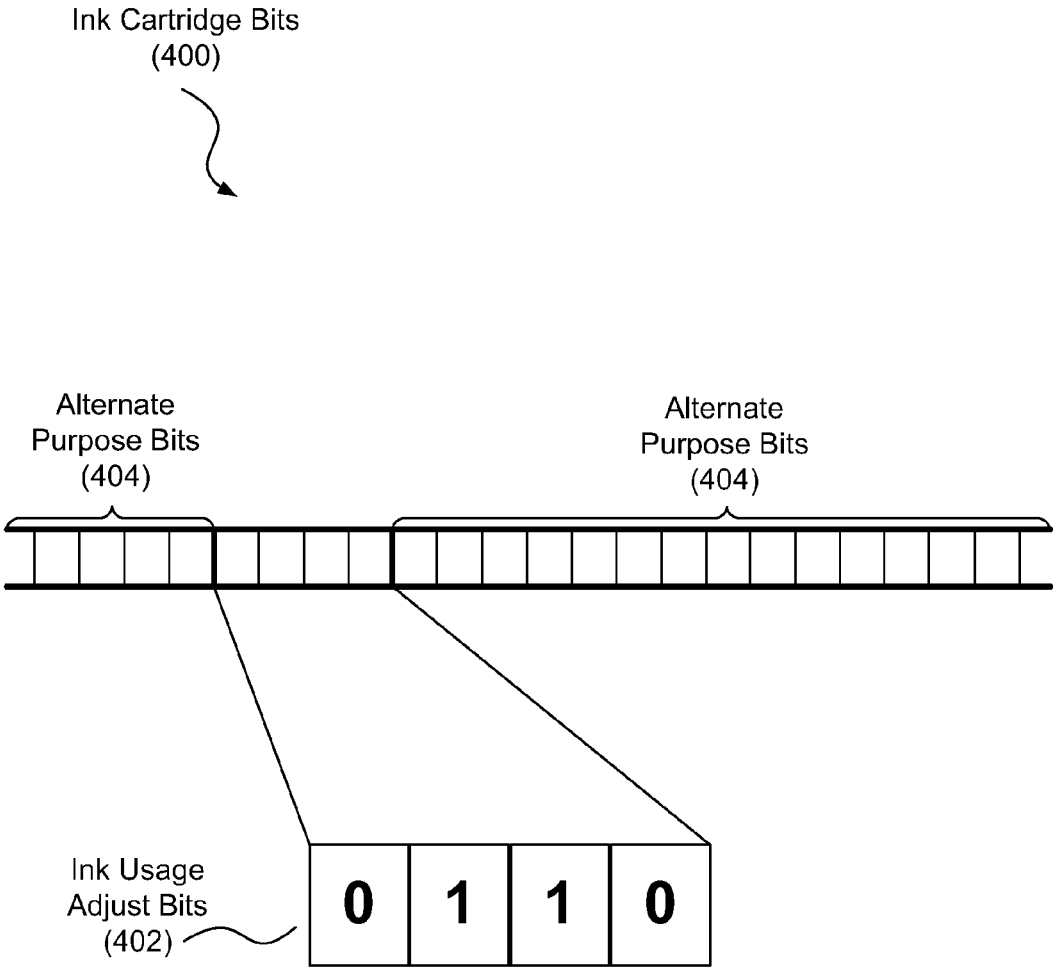
FIG. 4 is a diagram showing illustrative ink cartridge bits, according to one embodiment of principles described herein.

FIG. 4 is a diagram showing illustrative ink cartridge bits (400). As described above, an ink cartridge may include a small memory device configured to inform a printing system utilizing the ink cartridge of some of its properties, including an ink usage adjustment value. According to certain illustrative embodiments, the ink usage adjustment value is given as a number of ink usage adjustment bits (402). These bits may be part of a string of bits (404) providing additional information about the ink cartridge. Such additional information may include, but are not limited to, the color of the ink stored in the chamber of the ink cartridge and the type of ink stored in the chamber.

FIG. 4 illustrates four bits being designated as ink usage adjustment bits. However, any number of bits may be used to represent an ink usage adjustment value. Generally, more bits designated as ink usage adjustment bits allows for a finer tuning of ink usage by a printing system utilizing the ink cartridge. In some embodiments, the ink usage adjustment bits may be read only. That is, once the bits have been initially programmed, they are not able to be rewritten. The programming of the bits may be performed during or soon after the manufacturing process.

FIG. 5 is a diagram showing an illustrative ink usage adjustment value table (500). The ink usage adjustment value table (500) includes an ink usage adjustment bits column (502) and an ink usage adjustment value column (504). According to certain illustrative embodiments, the ink usage adjustment bits represent ink usage adjustment values for alternate print modes (506), standard ink usage adjustment (508), and a nominal ink usage adjustment (510).

Like FIG. 4, FIG. 5 illustrates a memory which designates four bits as ink usage adjustment bits (502). However, as mentioned above, a system embodying principles described herein may use any practical number of bits. By using four bits, 16 different values may be represented. Each value may represent a percentage of a nominal value. For example, the bits "0100" may indicate to the printing system to use 94% of the nominal ink usage. Similarly, the bits "1101" may indicate to the printing system to use 104% of the nominal ink usage. In some cases, the ink cartridge may indicate to the printing system that no adjustment to the ink usage is to be made. This may be the case if no adjustment to the ink usage will still allow the ink usage of the ink cartridge to reach a target ink usage.

In one example, the ink usage adjustment bits may inform the printing system to use a range of percentages of the default ink value depending on the application. In another example, the ink usage adjustment bits may inform the printing system to use a materially different percentage, such as but not limited to 40 percent or more, of the default ink usage value depending on the application. Such a percentage of the nominal ink usage may be materially outside of the standard ink usage range.

In an example, the ink usage adjustment value of an ink cartridge can be changed at any time during use of the ink cartridge. For example, a user may desire a different target ink usage than the standard target ink usage set by the manufacturer. Through use of a software application designed to interface with the hardware of the printer, a user may inform the printing system utilizing a particular ink cartridge to override the ink usage adjustment value provided by the ink cartridge adjustment bits. The user may then specify a different target ink usage.

Figure 6:
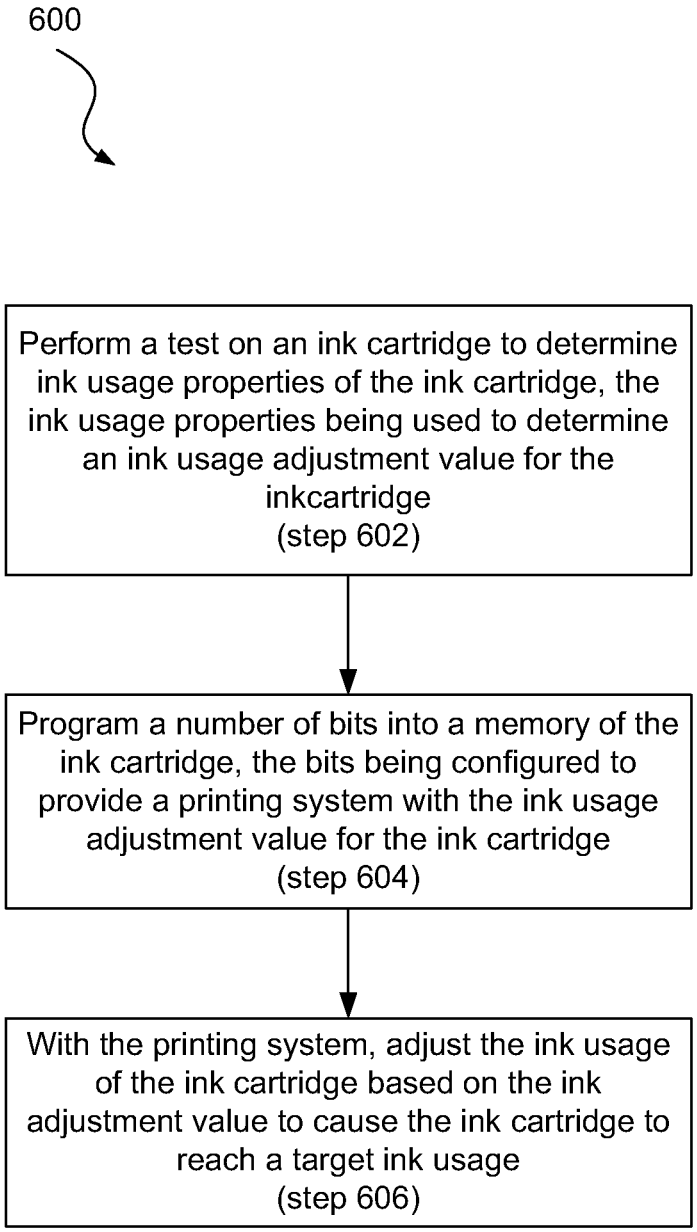
FIG. 6 is a flowchart showing an illustrative method for tuning ink usage of a printing system, according to one embodiment of principles described herein.

FIG. 6 is a flowchart showing an illustrative method for tuning ink usage of a printing system. According to certain illustrative embodiments, the method may include performing (step 602) a test on an ink cartridge to determine ink usage properties of the ink cartridge, the ink usage properties being used to determine an ink usage adjustment value for the ink cartridge; programming (step 604) a number of bits into a memory of the ink cartridge, the bits being configured to provide a printing system with the ink usage adjustment value for the ink cartridge; and with the printing system, adjusting (step 606) the ink usage of the ink cartridge based on the ink adjustment value to cause the ink cartridge to reach a target ink usage.

In sum, through use of methods and systems embodying principles described herein, an ink cartridge is provided that reaches a target ink usage. The amount of ink usage adjustment required to reach a target ink usage may not result in a noticeable difference in the printed image. Furthermore, a standard ink cartridge may be manufactured. That standard ink cartridge may be used to hold ink types having different physical and chemical properties. The ink usage may then be adjusted to compensate for the differences in physical and chemical properties.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A method for tuning ink usage, the method comprising:

storing an ink usage adjustment value in a memory of an ink cartridge; and with a printing system utilizing said ink cartridge, adjusting an ink usage of said ink cartridge based on said ink usage adjustment value;

in which said ink usage adjustment value is a percentage of a nominal ink usage value calculated using a predetermined ink cartridge design.

2. The method of claim 1, in which said ink usage adjustment value is based on ink usage properties of said ink cartridge, said ink usage properties determined by performing a test on said ink cartridge.

3. The method of claim 1, in which said ink usage adjustment value is determined based on physical properties of ink within said ink cartridge.

4. The method of claim 1, in which said ink usage is adjusted by an amount to cause said ink cartridge to reach a target ink usage.

5. The method of claims 1, in which adjusting said ink usage comprises adjusting an amount of nozzle firings during a print job.

6. The method of claims 1, further comprising changing said ink usage adjustment value to a new ink usage adjustment value at any time during usage of said ink cartridge.

7. An ink cartridge comprising:

a memory for storing an ink usage adjustment value, said ink usage adjustment value based on ink usage properties of said cartridge;

in which a printing system utilizing said ink cartridge adjusts an ink usage of said ink cartridge based on said ink usage adjustment value; and in which to adjust said ink usage comprises adjusting a number of nozzle firings for a particular print job.

8. The ink cartridge of claim 7, in which said ink usage properties are determined by a test performed on said ink cartridge.

9. The ink cartridge of claims 7, in which said ink usage is adjusted by said printing system to cause said ink cartridge to reach a target ink usage.

10. The ink cartridge of claims 7, in which said ink usage adjustment value is a percentage of a nominal ink usage value.

11. The ink cartridge of claims 7, in which said ink usage adjustment value is selectively changed to a new ink usage adjustment value at any time during usage of said ink cartridge.

12. A printing system capable of tuning ink usage, the printing system comprising:

a control system comprising a processor and a memory;

at least one ink cartridge, said ink cartridge comprising:

a memory for storing an ink usage adjustment value, said ink usage adjustment value based on ink usage properties of said ink cartridge determined by a test performed on said ink cartridge prior to installation of the cartridge into the printing system;

in which said control system adjusts a usage of said at least one ink cartridge based on said ink usage adjustment value; said ink usage adjustment value being a percentage of a nominal ink usage adjustment value calculated using a predetermined ink cartridge design.

13. The system of claim 12, in which said ink usage is adjusted by said control system to cause said ink cartridge to reach a target ink usage.

* * * * *